United States Patent [19]

Willett et al.

[11] Patent Number: 4,575,986

[45] Date of Patent: Mar. 18, 1986

[54] METHOD AND APPARATUS FOR PACKAGING GARMENTS

[75] Inventors: Richard A. Willett, Snellville; Fred J. Faletti, Atlanta; Paul A. Faletti, Lilburn, all of Ga.

[73] Assignee: All-Pak, Inc., Decatur, Ga.

[21] Appl. No.: 568,704

[22] Filed: Jan. 6, 1984

[51] Int. Cl.[4] ..... B65B 63/04

[52] U.S. Cl. ..... 53/118; 53/551

[58] Field of Search ..... 53/118, 119, 429, 430, 53/434, 450, 459, 469, 550, 567, 570, 117, 256, 258

[56] References Cited

U.S. PATENT DOCUMENTS

| | | | |
|---|---|---|---|
| 2,982,068 | 5/1961 | Pape et al. | 53/567 |
| 3,280,533 | 10/1966 | Hall | 53/119 |
| 3,514,019 | 5/1970 | Glaze et al. | 53/429 X |
| 3,824,763 | 7/1974 | Lewis | 53/570 X |
| 4,241,562 | 12/1980 | Meyer | 53/459 X |
| 4,295,322 | 10/1981 | Kuipers | 53/450 |
| 4,385,478 | 5/1983 | Veerkamp | 53/118 |

FOREIGN PATENT DOCUMENTS

| | | | |
|---|---|---|---|
| 1438248 | 6/1976 | United Kingdom | 53/258 |

*Primary Examiner*—John Sipos
*Assistant Examiner*—Steven P. Weihrouch
*Attorney, Agent, or Firm*—Thomas & Kennedy

[57] ABSTRACT

A method and apparatus is described for packaging a light-weight, flimsy garment such as hosiery in light-weight, flimsy packaging material such as plastic film. A garment is drawn by air pressure into a packing chamber and about a rotating spindle. The packed garment is then pushed off of the spindle by a plunger into and through a tubular strip of packaging material and into a closed end portion thereof. The packed closed end portion of the strip is then sealed and severed.

1 Claim, 19 Drawing Figures

36
35
41
30
29
45
17
40
28
23
60
20
13
26
24
25
10

7B
36
40
58
70
72
23
7B
76
75
H
95
95

72
40
58
64
70
60

6B
36
40
75
70
72
H
23
6B
72
40
23
58
64
60
H

METHOD AND APPARATUS FOR PACKAGING GARMENTS

TECHNICAL FIELD

This invention relates generally to methods and apparatuses for packaging garments, and particularly to methods and apparatuses for packaging flimsy, light-weight garments such as hosiery in packaging material of a similar character.

BACKGROUND OF THE INVENTION

Heretofore, flimsy, light-weight garments such as hosiery have been manually packaged into light-weight, thin, plastic bags for distribution and sale. This procedure has entailed a manual folding or bundling of the hosiery followed by manually insertion of the bundled hosiery into a preformed pouch of plastic packaging film followed by a double folding or heat sealing of the opened end of the pouch. This has been a time-consuming and costly procedure.

More recently, machines, such as that disclosed in U.S. Pat. No. 4,385,478, has been devised for folding and packing items of hosiery sequentially into a series of connected, pouch-like envelopes that are heat sealed and severed. Though such machines and procedures have bundled flimsy garments satisfactorily, they have not packaged them in a satisfactory manner. Their use therefore has largely been limited to automated bundling operations preparatory to manual packaging operations.

The primary reason for the just described use restriction lies in the fact that garments like hosiery have a surface that tends to cling to open tops of preformed pouches of film-like packaging material when gravity fed thereinto. Their light weight, irregularly packed configurations serve to aggravate this. It thus frequently occurs that the insertion of hosiery is incomplete which is to say that the hosiery is not gravity fed completely into a pouch. Again, this is not unexpected in view of the fact that bundled hosiery is very flimsy and yet offers subtantial surface resistance while at the same time the packaging material is also flimsy and difficult to maintain in a wide open top configuration at the time the hosiery is gravity fed thereinto. As a practical result, the above type machines have been primarily used only to bundle hosiery and to deliver the bundles to operators who then manually insert the machine-bundled hosiery into pouches of flexible packaging material.

It therefore remains desirable to provide a method and apparatus for packaging light-weight, flimsy garments such as hosiery that overcome the just described problems and limitations of the prior art. It is to the provision of such methods and apparatuses that the present invention is therefore primarily directed.

SUMMARY OF THE INVENTION

In one form of the invention a method of packaging a garment comprises the steps of drawing the garment by air pressure into a chamber about a rotating spindle whereby the garment is packed into a bundle. The bundled garment is mechanically pushed off of the spindle into and through an elongated tubular strip of packaging material and into a closed end portion of the tubular strip. The closed end portion of the tubular strip is then sealed and severed from the remainder of the strip with the garment enveloped within the closed end portion.

In another form of the invention apparatus for packaging garments comprises means for packing a garment into a bundle, means for forming flexible packaging material into an elongated tube, and means for pushing the bundled garment into the formed elongated tube of packaging material and into an end portion thereof. The apparatus also has means for sealing and severing the end portion of the elongated tube from the remainder of the tube with the garment enveloped within the closed end portion.

In yet another form of the invention apparatus for packaging garments comprises a garment packing chamber, a spindle mounted for rotary movement within the packing chamber, and vacuum in-feed means for drawing a garment into the packing chamber and about the spindle. The apparatus also has means for forming flexible packaging material into a tube and for positioning an end portion of the tube at a fill station. Plunger means for urging a packed garment off of the spindle and into the tube end portion are mounted for movement over the spindle between a position within the packing chamber and a position within a tube at the fill station.

BRIEF DESCRIPTION OF THE DRAWING

FIG. 4A is a side elevational view of the packing chamber portion of the apparatus illustrated in FIG. 1 with the chamber wall shown partially broken away to reveal internal components, while

FIG. 8 is a perspective view of one heater jaw for sealing a tube of packaging material while

FIG. 10A is a diagrammical plan view while

DETAILED DESCRIPTION

Figure 1:
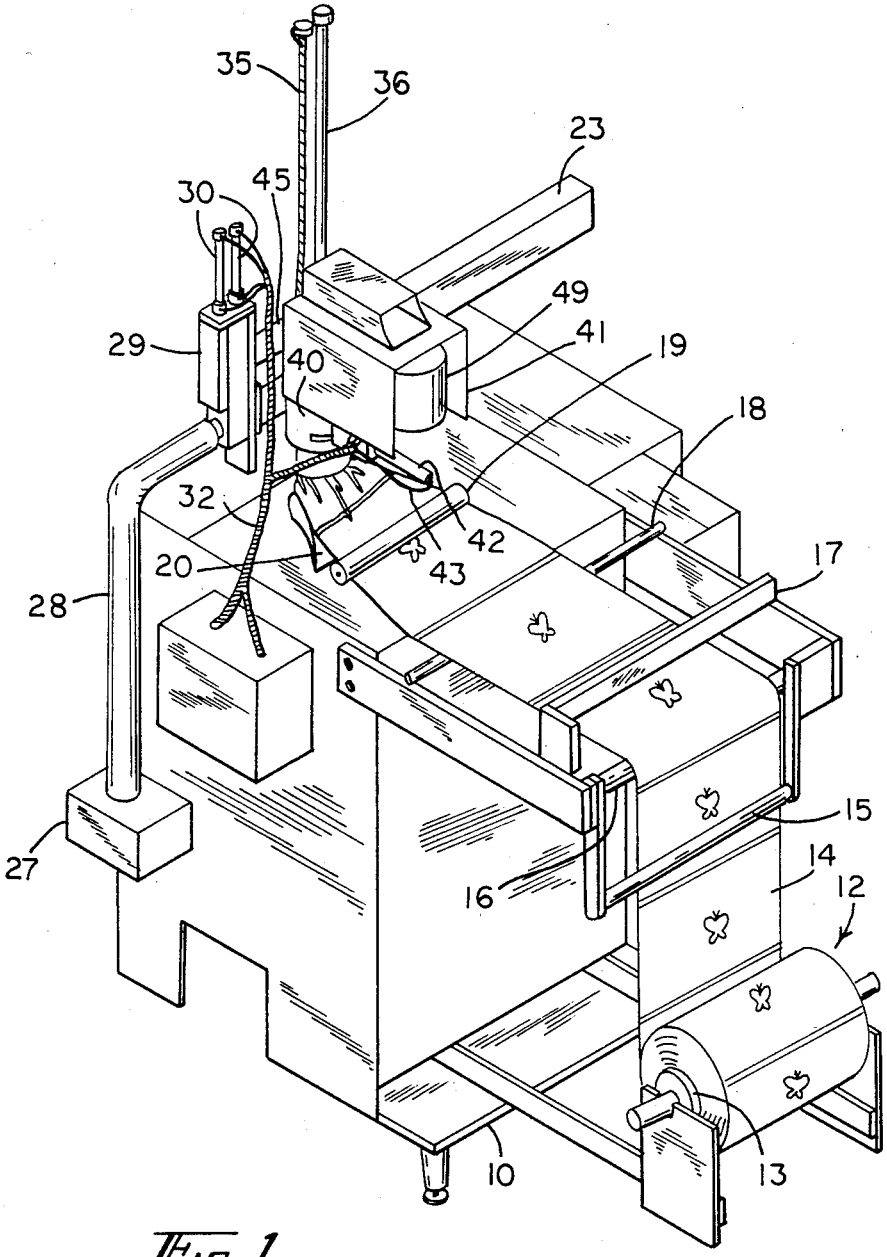
FIG. 1 is a perspective view of the in-feed side of apparatus for packaging garments in accordance with the present invention.
Figure 2:
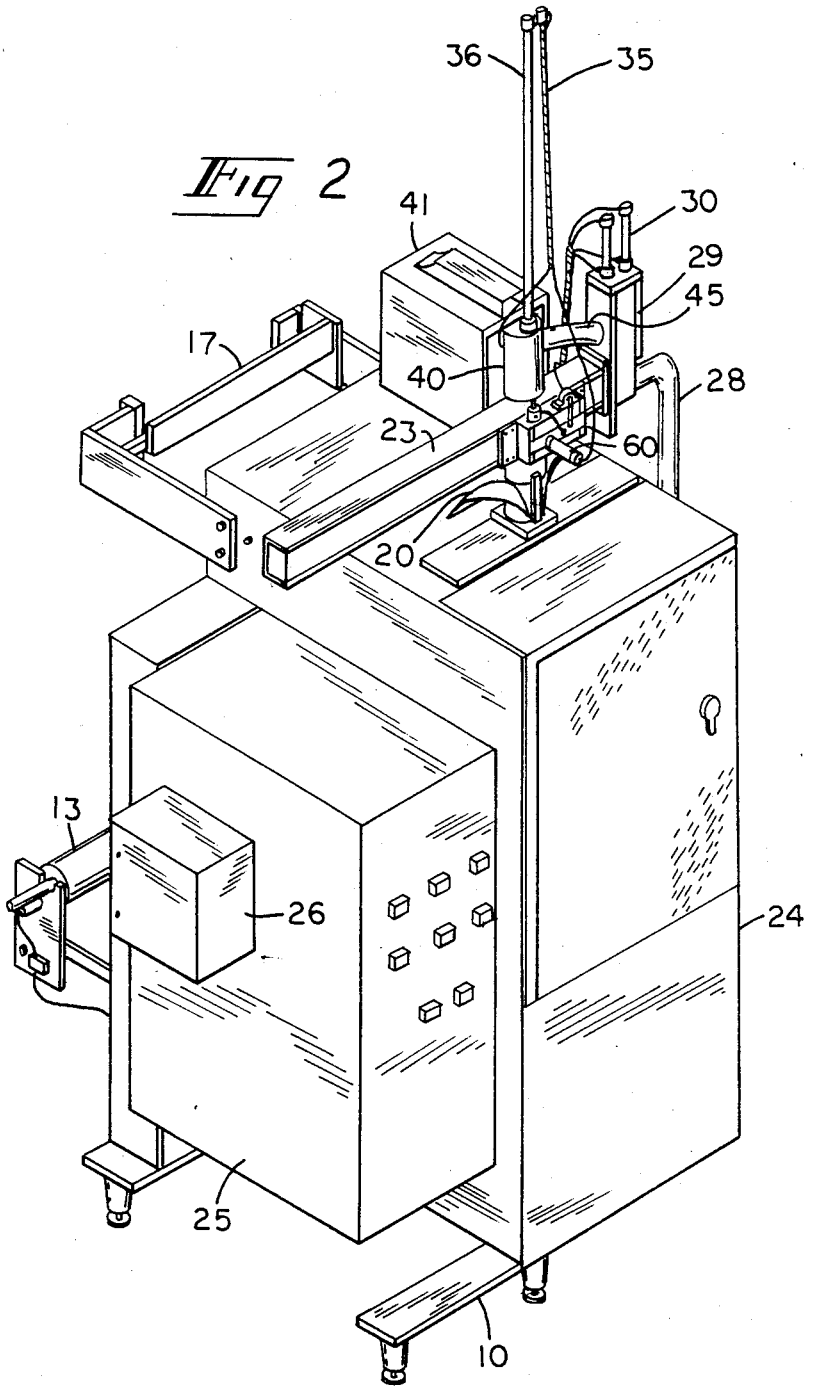
FIG. 2 is a perspective view of an out-feed side of the apparatus illustrated in FIG. 1.

Referring now in more detail to the drawing, and particularly to FIGS. 1 and 2, there is shown garment packaging apparatus having a frame 10 which rotatably supports a supply roll 12 of flexible, plastic packaging film upon a spool 13. An elongated strip of packaging film 14 is fed from the supply roll 12 under a guide roller 15, over another guide roller 16 and beneath a label imprinter 17. From beneath the label imprinter the film 14 is fed over a guide bar 18, beneath a roller 19, over an arcuately shaped film former 20, which forms the film strip into a tubular shape, and then down into the apparatus housing 24 in which a garment fill station is located.

Other components of the apparatus which are shown in FIGS. 1 and 2 include a garment in-feed channel 23, a main control box 25, an auxiliary control box 26, and a vacuum motor housing 27. A vacuum line 28 is seen to extend upwardly from the vacuum motor housing 27 to a plenum chamber 29 atop which two vacuum shuddle valves 30 upwardly extend. An air line 32 extends from another control box to the shuddle valves 30. Another air line 35 is provided for supplying air to a vertical air cylinder 36 mounted atop a garment packing chamber 40. A lateral air cylinder 42, which is fed by a branch air line 43 off of line 32, is located beneath a cover plate 41. Yet another air line 45 extends from the plenum chamber 29 to the packing chamber 40 and to a hollow spindle 70 rotatably mounted therein. The spindle, which is not shown in FIGS. 1 and 2, is driven by a motor located within a motor housing 49.

Figure 3:
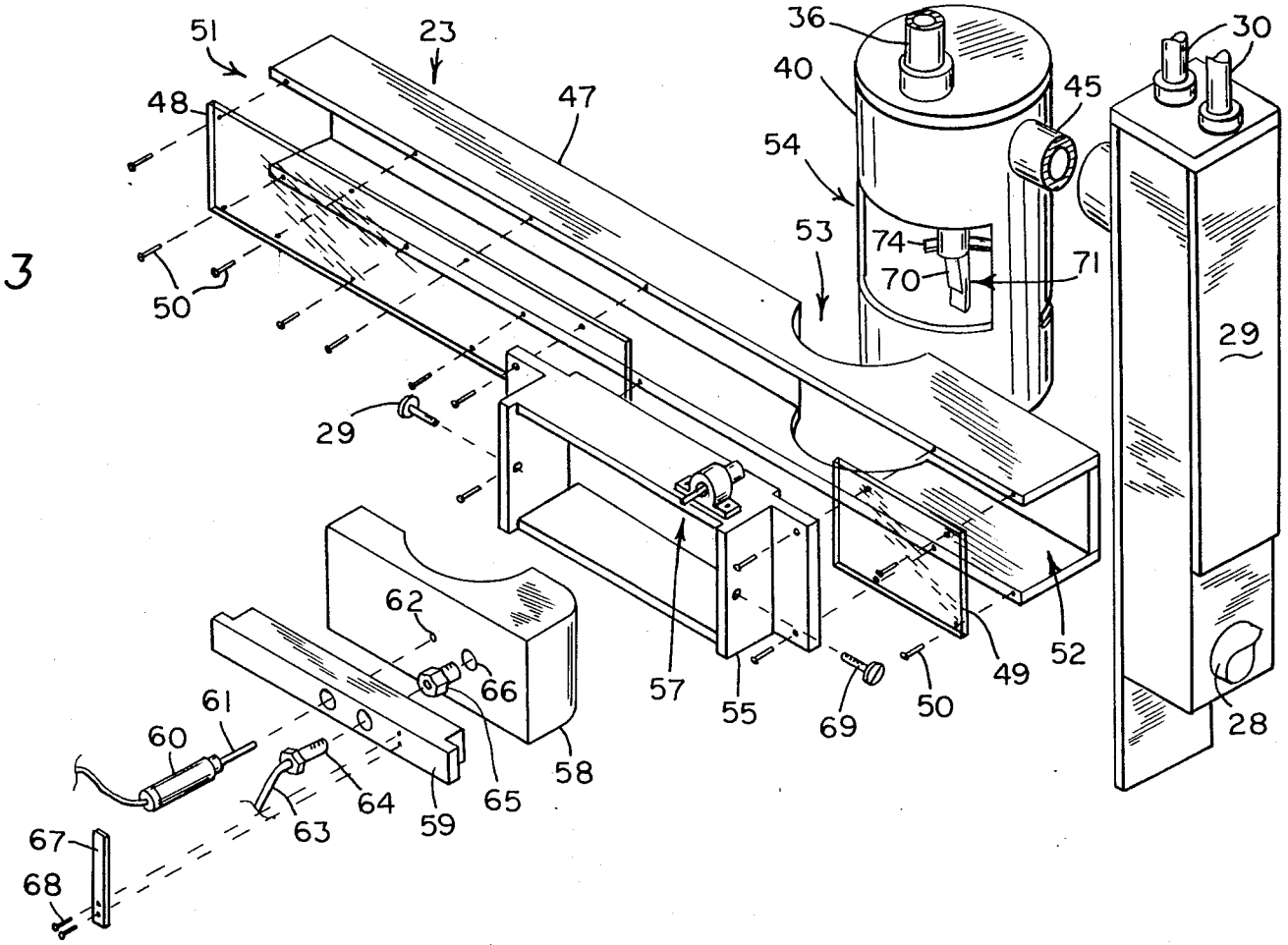
FIG. 3 is an exploded view, in perspective, of a garment in-feed portion of the apparatus shown in FIG. 1.
Figure 5A:
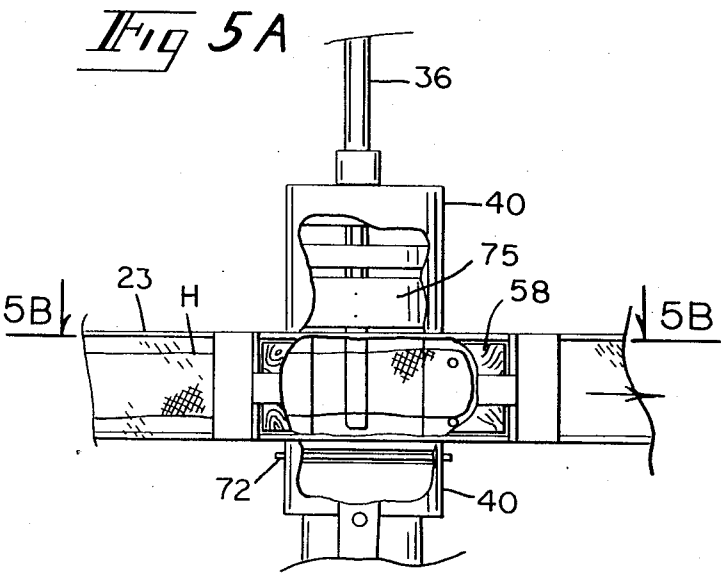
FIGS. 5A and 5B illustrate the packing chamber as shown in FIGS. 4A and 4B with the pantyhose positioned in front of the packing chamber.
Figure 5B:
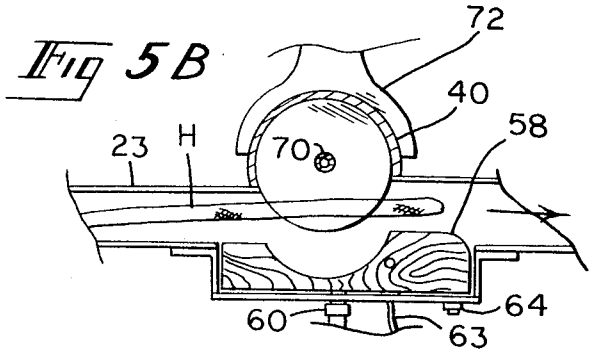

With reference next to FIG. 3 the garment in-feed channel 23 is seen to be comprised of a U-shaped channel member 47 which is partially covered by two transparent, plastic panels 48 and 49 and secured thereto by screws 50. The garment in-feed channel entry end 51 is open as is its opposite end 52 which communicates with the plenum chamber 29. The in-feed channel is formed with an arcuate cut-out area 53 against which the garment packing chamber 40 is abutted with a chamber window 54 exposed to the interior of the in-feed chamber. A tubular mounting plate 55 is secured by screws 50 over the transparent plates 48 and 49 to the U-shaped channel member 47 opposite the arcuate cut-out area 53. A safety switch, indicated generally at 57, is mounted atop the tubular mounting plate 55 while an air lock block 58 is slidably seated within the mounting plate 55. A mounting bracket 59 secured to the frame by a plate 67 and screws 68 is rigidly secured by screws 69 to the mounting plate 55 but not to the air lock block. An air cylinder 60 is mounted to the bracket 59 with a cylinder rod 61 secured within a mounting hole 62 of the air lock block 58. An air line 63 extends from air line 35 to a fitting 64 that extends through the mounting plate 59 and into a mating hollow bolt 65 that is mounted securely within a hole 66 formed in the air lock block.

FIGS. 4–7 show the just-described components of the in-feed channel and packing chamber in an operatively assembled configuration. Here also a valve shut-off plate 72 is seen to be mounted for lateral, sliding movement through a slot 74 formed in a lower side portion of the packing chamber 40 upon operation of the cylinder 42. A plunger 75 is mounted on the lower end of a plunger rod 76 which extends through the hollow spindle 70 and through a guide disk 77 fixedly mounted within an upper portion of the chamber 40. A pair of photoelectric cells 59 is mounted to the pack chamber 40. A pair of film spreader rods 95 is mounted at a fill station below the packing chamber.

Figure 9:
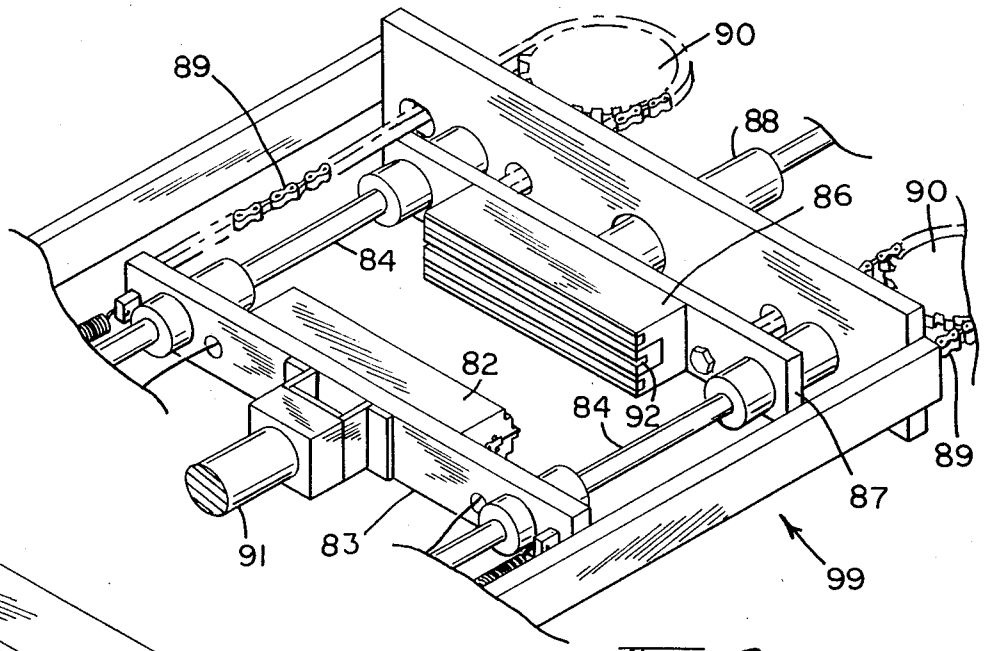
FIG. 9 is a perspective view of a heat sealing and severing mechanism that includes the heating block shown in FIG. 8.
Figure 8:
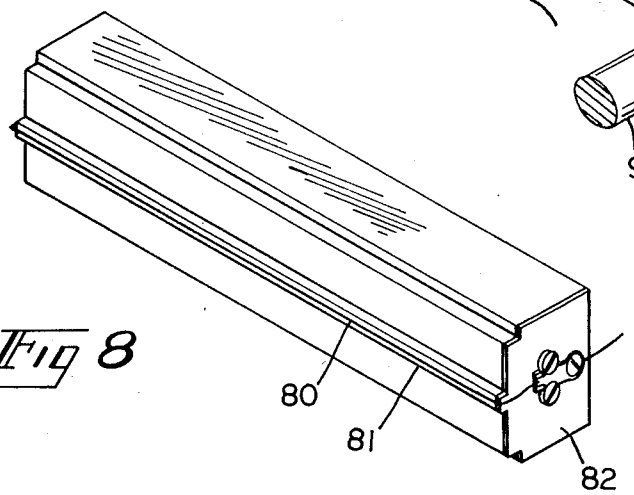
Figure 12A:
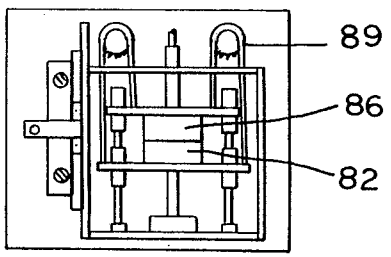
FIGS. 12A and 12B are also the same as FIGS. 10A and 10B, respectively, but with the heat sealing and severing mechanism now having drawn the packaging material downwardly and having severed the packed and sealed lower end portion from the remainder of the tube.
Figure 10A:
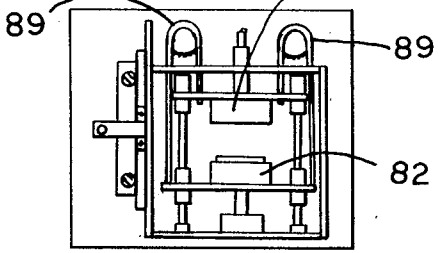
Figure 10B:
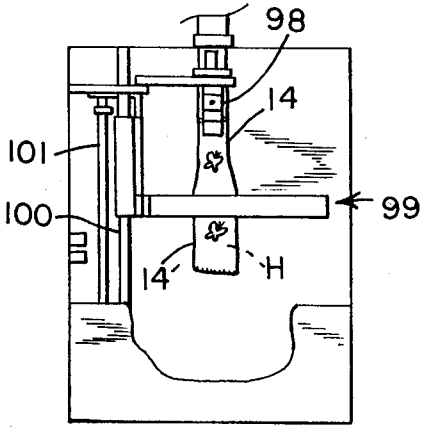
FIG. 10B is a diagrammical side view of a tube of flexible packaging material having a lower end portion filled with a garment preparatory to sealing and severing of the end portion with the heat sealing and severing mechanism shown in FIG. 9.

With reference next to FIGS. 8 and 9, the packaging apparatus is further seen to include means indicated generally at 99 for successively heat sealing, drawing and severing lower end portions of the strip of tubularly formed packaging film from the remainder of the strip. This means, which is of conventional structure in such vertical form and fill packaging machines as a Gainsborough Engineering Company GV model or one of those disclosed in U.S. Pat. Nos. 4,144,693 and 4,171,605, is seen to include an electrical resistance element or hot wire 80 mounted along an insulated bridge portion 81 of a jaw 82 that is rigidly mounted to a drive bar 83 which is mounted for reciprocal, sliding motion upon two guide rods 84. A mating jaw 86 is rigidly mounted upon another mounting plate 87 which is mounted also for reciprocal, sliding movement upon the guide rods 84 when driven by a cylinder 88. Two chains 89 are routed over free-wheeling sprockets 90 and connected at one end to the guide bar 83 and at the other end to the guide bar 87. The jaw 86 has a lateral recess or notch 92 sized to accommodate the bridge 80 of the other jaw 82 and the hot wire 81. So constructed, upon actuation of the cylinder 88 the two jaws 82 and 86 are simultaneously driven towards one another from their position shown in FIG. 9 upon the guide rods 84 whereupon a vertically depending strip of packaging film located therebetween is forced into the recess 92 and heat sealed and severed by the hot wire 80. Upon reverse movement of the cylinder 88 the two jaws separate whereupon a heat sealed and severed lower portion of the film strip may fall free from the remainder of the elongated strip while leaving the succeeding lower end of the strip also heat sealed. The heat sealing and severing mechanism is also mounted for vertical movement upon guide rods 100 when driven by a cylinder 101 as shown in FIGS. 10–12. As also shown in these figures the apparatus further includes a conventional vertical seam sealer generally indicated at 98.

OPERATIVE DESCRIPTION

Figure 4A:
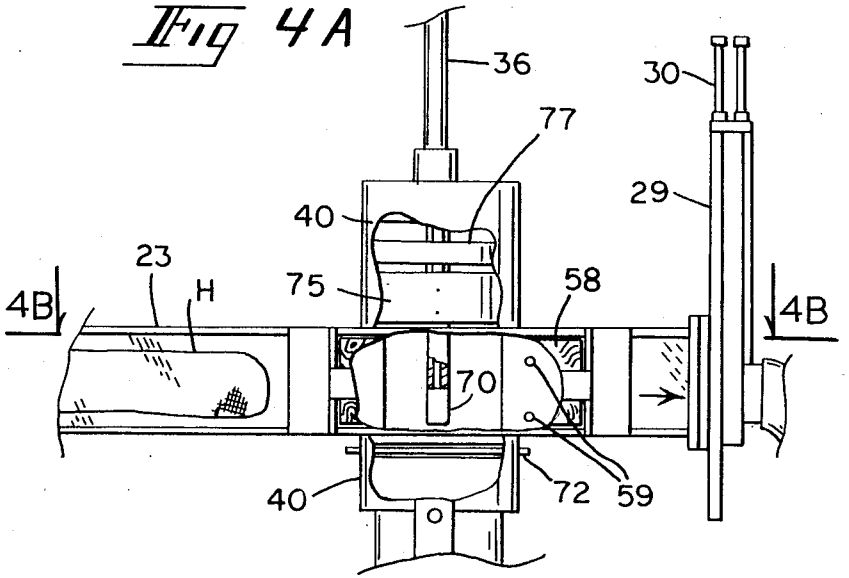
Figure 4B:
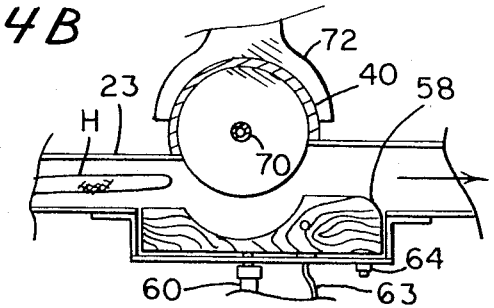
FIG. 4B is a plan view in section taken along plane 4B—4B, of the chamber illustrated in FIG. 4A with a pantyhose shown approaching the packing chamber.
Figures 6A, 6B, 7A, 7B:
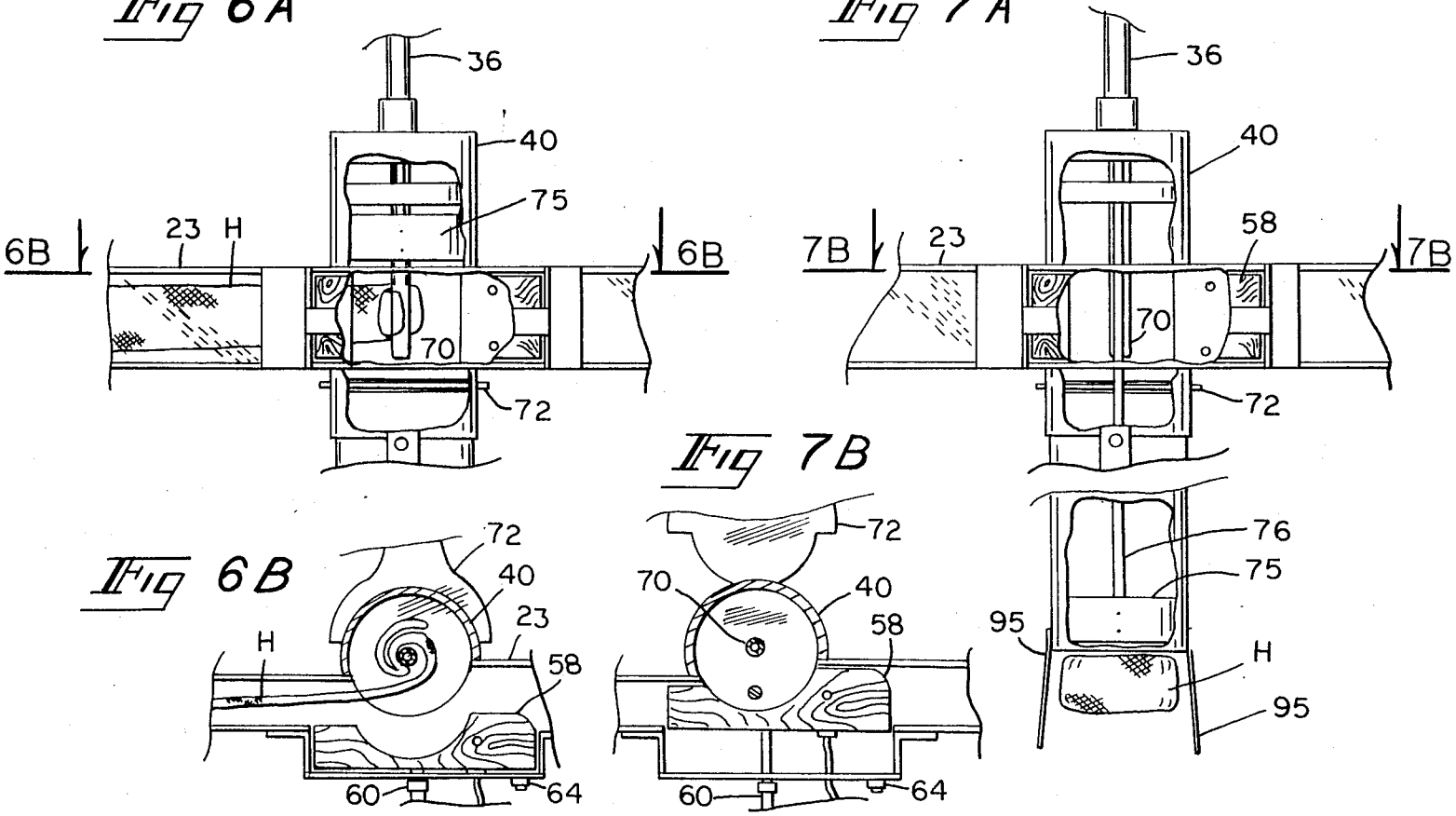
FIGS. 6A and 6B illustrate the packing chamber with the pantyhose partially drawn into the packing chamber about a spindle.
FIGS. 7A and 7B illustrate the packing chamber with the pantyhose urged out of the chamber and into the bottom portion of a tube of packaging material.

The apparatus is controlled by a conventional electrical and pneumatic control circuit which for clarity and conciseness has not been detailed. In operation the strip of packaging film 14 is drawn from the supply roll 12 by downward movement of the heat sealing and severing mechanism 99. The strip is formed by former 20 into a tubular shape whose vertical seam is sealed by the heat sealer 98. A garment such as a pantyhose H, is manually introduced into the entry end 51 of the in-feed channel 23 whereupon it is drawn toward the plenum chamber 29 by means of suction applied to the chamber by the vacuum motor enclosed in housing 27. When the leading edge of the pantyhose H passes in front of the photoelectric cells 59, as shown in the FIG. 5, the suction applied to channel 23 is terminated and suction is applied to the packing chamber through air line 45 which communicates with a channel that extends down through the rotating spindle 70 to an orifice 71 located in a lower portion thereof. During this time the valve plate 72 is in the closed position as shown in FIG. 4B and as a result the panythose H is drawn from the in-feed channel 23 into the packing chamber 40 and about the rotating spindle 70 as shown in FIG. 6. Next the valve plate 72 is withdrawn from within the lower portion of the packing chamber and the air lock block 58 driven by cylinder 60 into the position shown in FIG. 7B sealing off the packing chamber from the in-feed channel. At the same time air is forced into the packing chamber through valve 64 in the air lock block as an additional means of forcing the pantyhose into the packing chamber and about the rotating spindle. Next the plunger 75 is moved downwardly as shown in FIG. 7A driving the pantyhose H into the lower portion 14 of the tubular strip of packaging material. As shown in FIG. 7A the plunger or piston 75 is driven downwardly by actuation of rod 76 to a position just within the upper bounds of the spreader rods 95. In this matter it is seen that the pantyhose is positively driven into a lower portion of the tubular strip of packaging material.

Figure 12B:
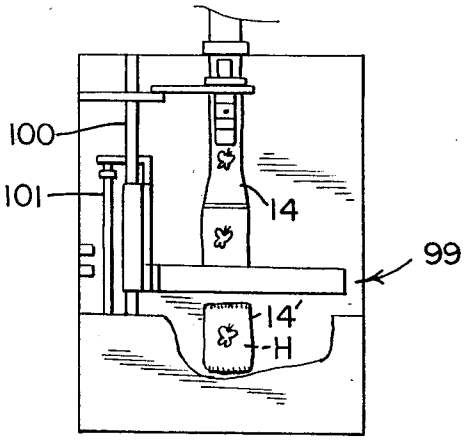
Figure 11A:
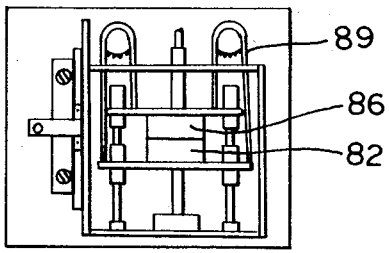
FIGS. 11A and 11B are the same as FIGS. 10A and 10B, respectively, but with the heat sealing and severing mechanism positioned in sealing contact with the flexible packaging material.
Figure 11B:
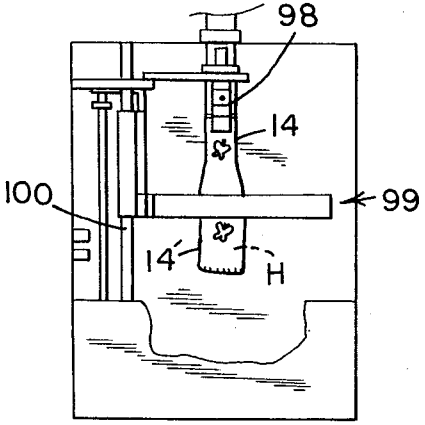

With reference next to FIGS. 10–12 the sequence of sealing and severing the lower portion 14' from the remainder of packaging material 14 is shown. In FIG. 10 it is seen that the two jaws 82 and 86 are in an open position allowing the plunger 75 to drive the pantyhose into the lower portion 14'. It is also seen here that the sealing and severing apparatus 99 is in its upper position located at the height where the lower portion 14' is joined to the remainder of the tubular film strip 14. Next, the two jaws are driven together as shown in FIG. 11A whereupon the electrical resistance heating element 81 heat seals the tubular strip, which has been placed in a more flattened or oval shape by the spreader rods 95. If desired the bridge 80 may be disjoined from jaw 82 for added movement into the recess 92 of jaw 86 by operation of a cylinder rod 91 shown in FIG. 9. Thus the upper lip of the lower portion and the lower lip of the remainder of the film strip is heat sealed or cauterized and separated by this operation. Next, as shown in FIG. 12, the heat sealing and severing apparatus 99 is driven downwardly thereby drawing more of the material 14 off of the spool 12 and to bring into position another lower portion 14' of the strip for the next successive operations. Finally, with the opening of the jaws 82 and 86 the lower portion 14' is released whereupon it gravitates downwardly as shown in FIG. 12B with the pantyhose H completely sealed within an envelope of packaging material thereby completing one operation. At this point another pantyhose H may be introduced into the infeed channel and the sequence of operation repeated after repositioning of the apparatus components.

It thus is seen that a method and apparatus for packaging garments is provided which overcomes the previously mentioned limitations and restrictions of the prior art. It should be understood that the just-described embodiment, however, merely illustrates principles of the invention in one preferred form. Many modifications, additions, and deletions may, of course, be made thereto without departure from the spirit and scope of the invention as set forth in the following claims.

We claim:

1. Apparatus for packaging garments comprising, in combination, a generally vertically oriented tubular packing chamber; a spindle mounted for rotary movement within said packing chamber about a generally vertical axis to wind a garment about said spindle; a vacuum in-feed channel extending laterally from said packing chamber ; means for placing under vacuum said channel and packing chamber to draw a garment through said channel and into said packing chamber for bundling about said spindle; means for forming flexible packaging material into an elongated tube that extends downwardly from said tubular packing chamber and for successively drawing, sealing and severing end portions of said tube at a fill station located beneath said packing chamber; and plunger means mounted for generally vertical reciprocal movement over said spindle to and from said fill station for urging in direct contact therewith bundled garments off of said spindle and down into end portions of the tube of packaging material.

* * * * *